US006386989B1

(12) United States Patent
Huang

(10) Patent No.: US 6,386,989 B1
(45) Date of Patent: May 14, 2002

(54) GOLF CLUB GRIP ASSEMBLY

(76) Inventor: Ben Huang, 16652 Gemini La., Huntington Beach, CA (US) 92647

( * ) Notice: Subject to any disclaimer, the term of this patent is extended or adjusted under 35 U.S.C. 154(b) by 0 days.

(21) Appl. No.: 09/497,750

(22) Filed: Feb. 4, 2000

(51) Int. Cl.[7] ..... A63B 53/04; A63B 53/06; A63B 53/08

(52) U.S. Cl. ..... 473/300; 473/301; 473/298; 473/302

(58) Field of Search ..... 473/300, 301, 473/302, 305, 298; 29/283

(56) References Cited

U.S. PATENT DOCUMENTS

| | | | | |
|---|---|---|---|---|
| 621,993 | A | | 3/1899 | Crosier |
| 1,017,565 | A | | 2/1912 | Lard |
| 1,665,791 | A | | 4/1928 | Novak |
| 1,943,399 | A | * | 1/1934 | Smith ..... 273/81 |
| 2,941,806 | A | | 6/1960 | Stevens |
| 3,070,370 | A | | 12/1962 | Steiner |
| 3,252,706 | A | | 5/1966 | Rosasco |
| 3,311,375 | A | | 3/1967 | Onions |
| 3,524,646 | A | | 8/1970 | Wheeler |
| 5,145,171 | A | | 9/1992 | Head et al. |
| 5,478,074 | A | | 12/1995 | Storper |
| 5,513,845 | A | | 5/1996 | Sonagere |
| 5,584,482 | A | * | 12/1996 | Huang ..... 273/75 |
| 5,620,180 | A | | 4/1997 | Hong |
| 5,626,527 | A | | 5/1997 | Eberlein |
| 5,671,923 | A | * | 9/1997 | Huang ..... 473/300 |
| 5,730,662 | A | | 3/1998 | Rens |
| 5,797,813 | A | * | 8/1998 | Huang ..... 473/549 |
| 5,827,129 | A | * | 10/1998 | Huang ..... 473/301 |
| 5,895,329 | A | * | 4/1999 | Huang ..... 473/302 |

* cited by examiner

*Primary Examiner*—Jeanette Chapman
*Assistant Examiner*—Sneh Varma
(74) *Attorney, Agent, or Firm*—Fulwider Patton Lee & Utecht, LLP

(57) ABSTRACT

A grip assembly for the handle of a golf club where the grip assembly includes a resilient underlisting sleeve over which is spirally wrapped a resilient strip. The lower end of the underlisting sleeve includes a nipple formed with an upward facing circumferential groove. The lower end of the strip is urged into the confines of the groove to secure the lower end of the strip to the underlisting sleeve.

4 Claims, 3 Drawing Sheets

GOLF CLUB GRIP ASSEMBLY

BACKGROUND OF THE INVENTION

The present invention relates to an improved grip assembly for golf clubs and other sporting equipment employing handles subject to shock when such devices are impacted.

It is well known that the shock generated by impact between a golf club and a golf ball can adversely effect muscle tissue and arm joints. The energy generated by such impact is usually of high frequency and short duration with rapid decay and which is often known as "impact shock." Tight grasping of a golf club grip to keep it from slipping in a users hands contributes to such impact shock.

Applicant has previously developed resilient grips which successfully reduce or even eliminate impact shock to the muscle and arm joint of the users of golf clubs. See for example U.S. Pat. No. 5,797,813, granted to applicant Aug. 25, 1998. Such earlier grips utilize a polyurethane layer bonded to a felt layer to define a resilient strip, which is spirally wrapped around an underlisting sleeve, with such underlisting sleeve being slipped over the handle portion of a golf club shaft. After the underlisting sleeve has been properly positioned upon the golf club shaft, a synthetic plastic ferrule such as designated 56 in FIG. 18 of my U.S. Pat. No. 5,895,329 secures the grip in place on the handle of the golf club shaft. Alternatively, the lower end of the resilient strip may be secured to the lower end of the underlisting sleeve by a length of finishing tape. Installation of a ferrule is labor intensive, while the use of finishing tape does not provide a high quality commercial image.

SUMMARY OF THE INVENTION

The golf club grip assembly of my present invention eliminates the disadvantages of the afore mentioned synthetic plastic ferrule, or the use of finishing tape between the lower end of the grip and the handle of a golf club shaft.

DESCRIPTION OF A PREFERRED EMBODIMENT

Figure 1:
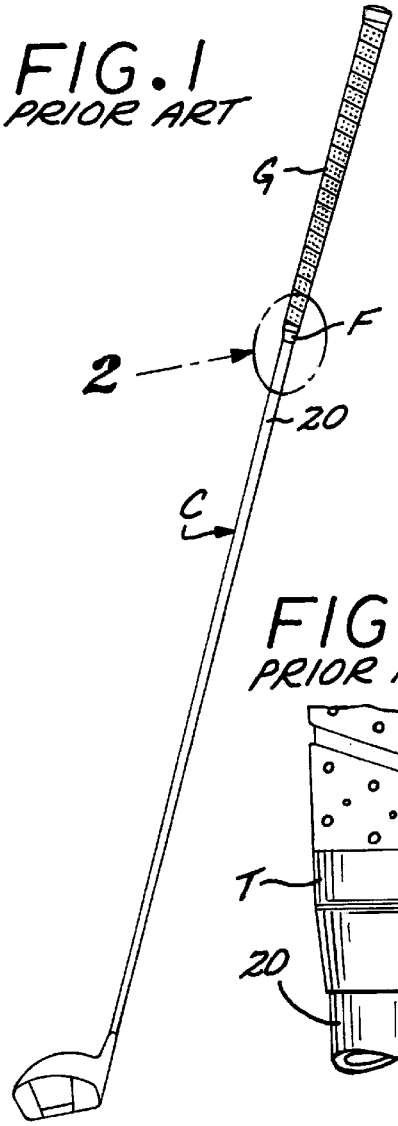
FIG. 1 PRIOR ART
FIGS. 1, 2 and 3 show typical prior art golf club grip assemblies which are subject to the aforementioned disadvantages.
Figure 2:
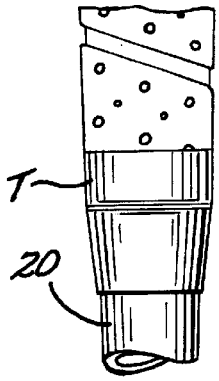
FIG. 2 PRIOR ART
Figure 3:
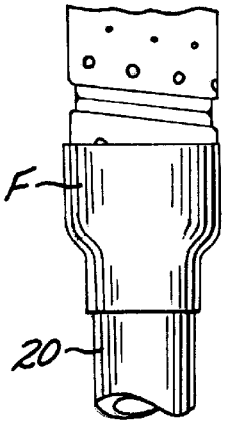
FIG. 3 PRIOR ART

Referring to the drawings, FIGS. 1 and 2 show typical prior art golf club grip assemblies wherein the golf club C has a shaft 20 upon the handle portion of which is installed a resilient slip-on grip G provided with a prior art ferrule F that secures the lower end of the grip G to the golf club shaft. FIG. 2 is an enlarged view of the encircled area 2 of FIG. 1. FIGS. 1 and 2 correspond to FIGS. 17 and 18 of my U.S. Pat. No. 5,895,329. Ferrule F is made of an inelastic synthetic plastic material. FIG. 3 is a view similar to FIG. 2 showing a length of finishing tape T spirally wrapped about the lower end of a resilient strip S to secure the lower end of such strip to an underlisting sleeve in accordance with the prior art.

Figure 4:
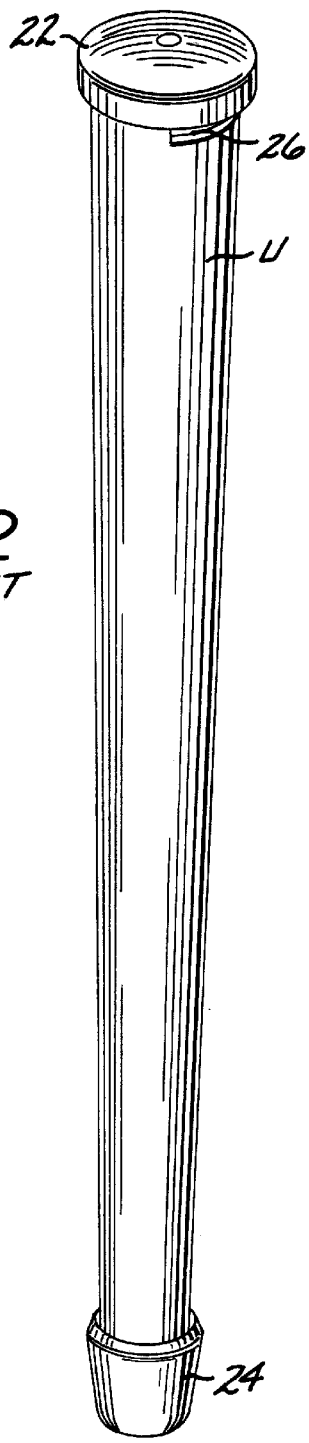
FIG. 4 is a perspective view of an underlisting sleeve of a golf club grip assembly embodying the present invention.
Figure 5:
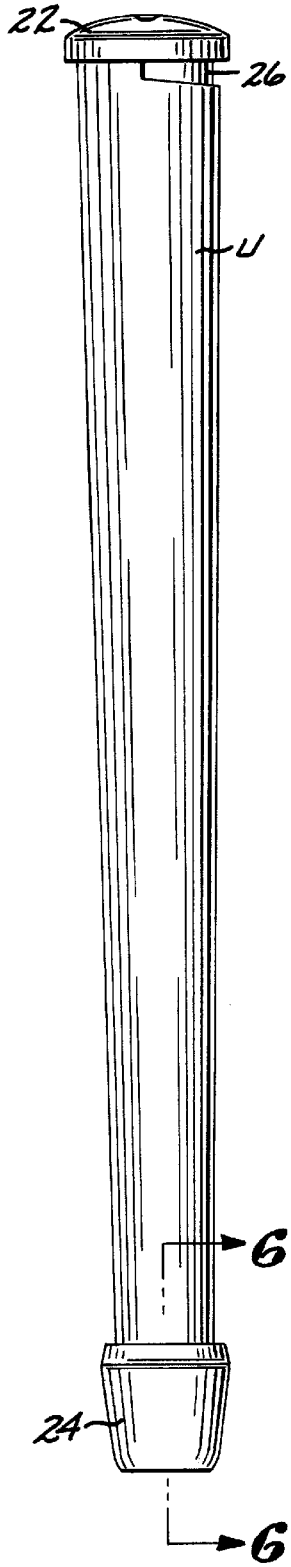
FIG. 5 is a side elevational view of the underlisting sleeve of FIG. 4.
Figure 6:
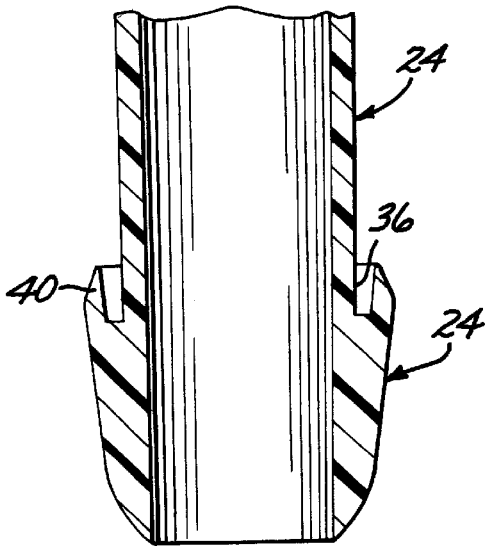
FIG. 6 is a vertical sectional view taken in enlarged scale along line 6—6 of FIG. 5.
Figure 7:
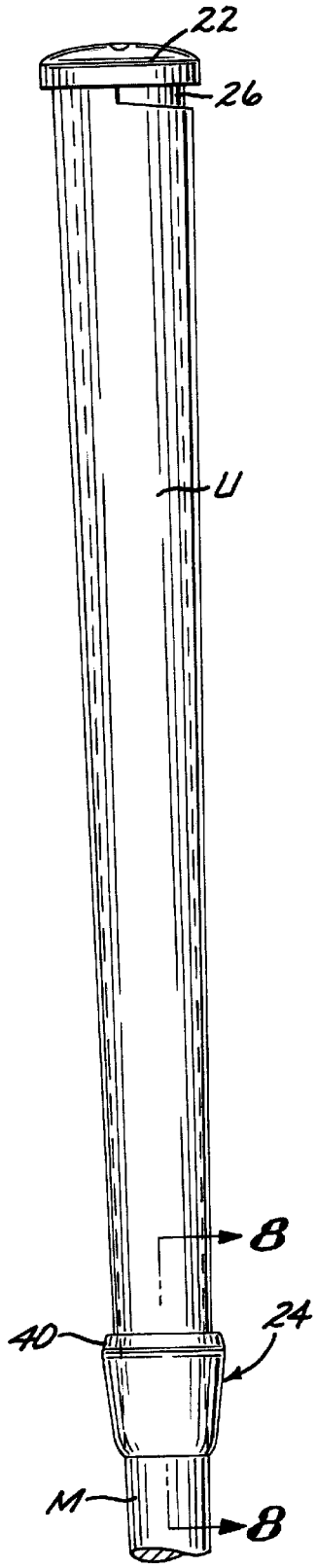
FIG. 7 is a side elevational view of the underlisting sleeve after it has been removable positioned upon a mandrel.
Figure 8:
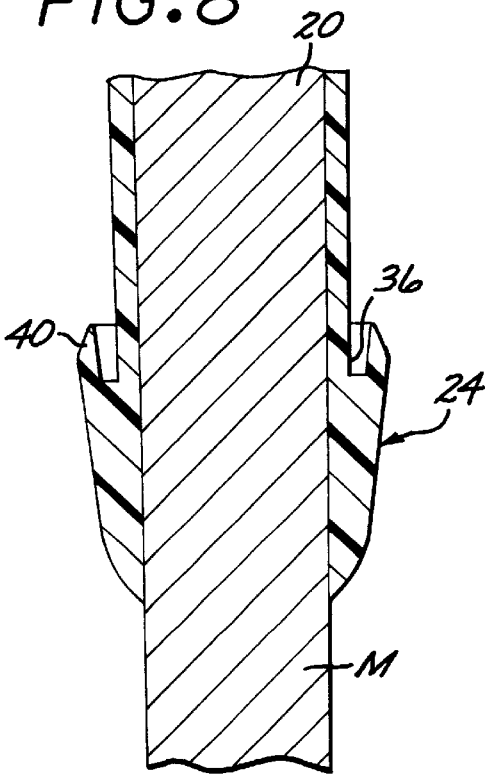
FIG. 8 is a vertical sectional view taken in enlarged scale along 8—8 of FIG. 7.
Figure 9:
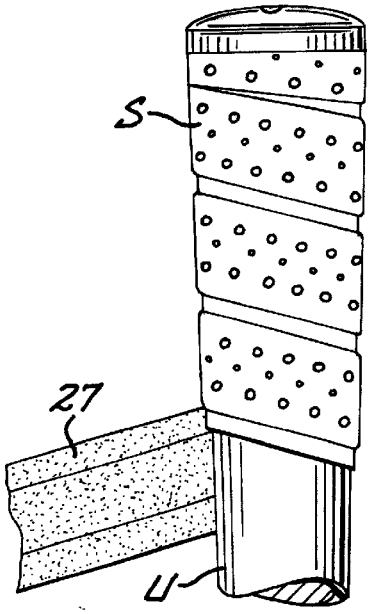
FIG. 9 is a broken side elevational view of a resilient strip being spirally wrapped about the underlisting sleeve.
Figure 10:
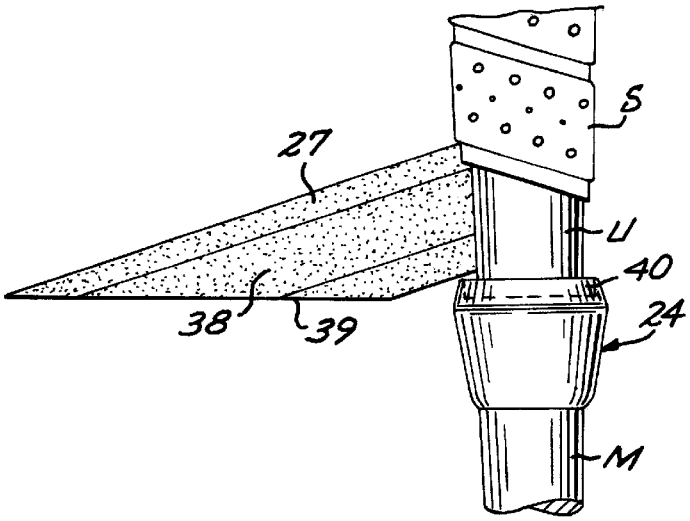
FIGS. 10 and 11 are broken side elevational views the showing the lower portion of the resilient strip being wrapped about the lower end of the underlisting sleeve.
Figure 11:
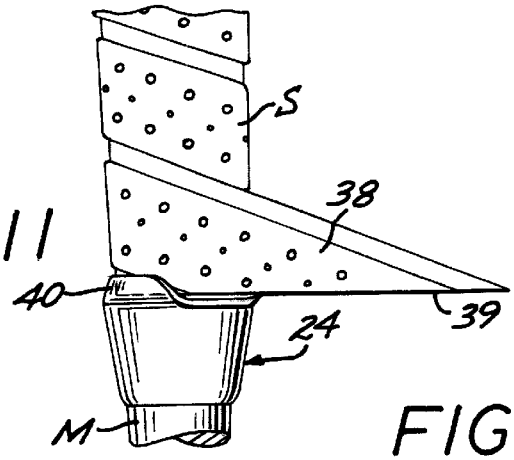
Figure 12:
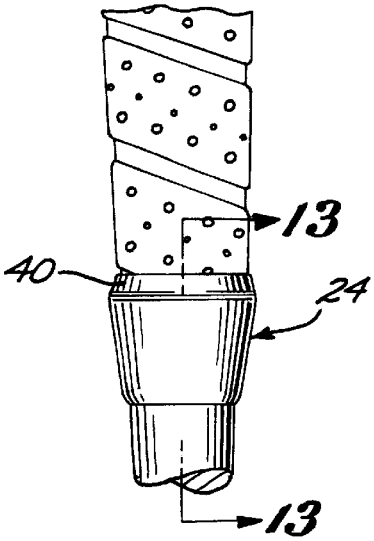
FIG. 12 is a broken side elevational view showing how the lower end of the resilient strip is retained upon the lower end of the underlisting sleeve.
Figure 13:
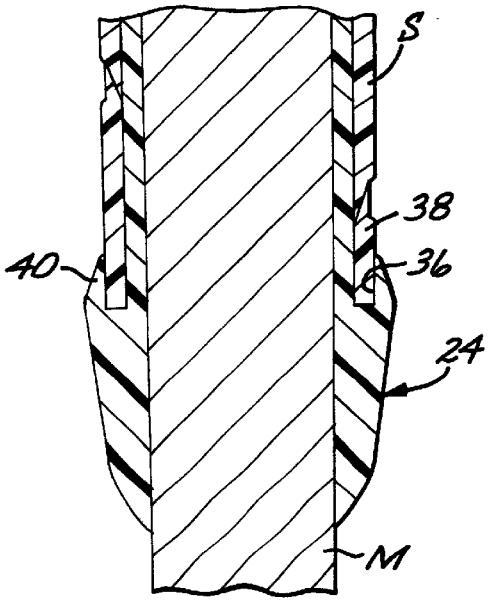
FIG. 13 is a sectional view taken enlarged scale along line 13—13 of FIG. 12.

Referring now to FIGS. 4 and 5, there is shown a resilient underlisting sleeve U employed in my new grip assembly. Such sleeve U is similar to that described in my U.S. Pat. No. 5,797,813 and includes an integral cap 22. The lower end of the sleeve is formed with an integral nipple 24. The upper portion of the sleeve U is formed with a groove 26 to receive the upper tip of a polyurethane-felt strip S, such as that described in my U.S. Pat. No. 5,797,813. Strip S is spirally wrapped about the body of the underlisting sleeve U, as shown in FIGS. 9–13. An adhesive 27 is applied to the underside of the strip. Referring to FIGS. 6, 7 and 8, the upper portion of nipple 24 is formed with an upwardly-facing circumferential groove 36 that receives the lowermost wrap 38 of resilient strip S, as indicated in FIGS. 11, 12, and 13.

In FIGS. 7 and 8, underlisting sleeve U is shown after it has been longitudinally positioned upon a mandrel M. In FIG. 9 the resilient strip S is shown being spirally wrapped about the underlisting sleeve U, starting at the upper end of the underlisting sleeve. In FIG. 10 the lower portion of the strip S is shown after it has been spirally wound to a position wherein its horizontally cut lower edge 39 is disposed in horizontal alignment with the lower portion of nipple groove 36. Thereafter, as indicated in FIG. 11 the lower end portion of the strip is manually urged into the confines of the groove 36 by temporarily expanding the peripheral lip 40 formed outwardly of the groove so as to admit the lower edge of the strip into the groove. When the lip 40 returns to its original position, the lip will securely retain the lower end of the strip to the upper portion of the nipple, as shown in FIGS. 12 and 13. The sleeve and strip combination may then be removed from the mandrel and slipped onto the handle portion of a golf club shaft in a conventional manner.

From the foregoing description it will be apparent that the resilient strip S may be installed on the underlisting sleeve U quickly and easily with a minimum amount of expenditure of labor by a golf club manufacturer. Moreover, a golf club grip assembly embodying the present invention provides a far more professional appearance that prior art grips utilizing finishing tape and at a lower cost that where finishing tape is utilized. My present grip also eliminates the cost of prior art ferrules and the labor required for their installation by a golf club manufacturer.

It will be understood that various modifications and changes may be made with respect to the above-described embodiment without departing from the scope of the present invention.

What is claimed is:

1. A golf club grip assembly comprising:

a resilient underlisting sleeve formed at its upper end with a cap and at its lower end with a nipple;

an upwardly facing circumferential groove formed in the upper portion of the nipple, the outer portion of the groove being defined by a flexible circumferential lip;

a resilient strip wrapped about and adhered to the underlisting sleeve between the underside of the cap and the lower portion of the groove of the nipple; and the lip being expandible outwardly to securely retain the lower end of the strip within the groove and retain the lower portion of the strip to the lower portion of the underlisting sleeve.

2. A golf club grip assembly comprising:

a resilient underlisting sleeve formed at its upper end with cap and with a first groove below the cap, said sleeve also being formed at its lower end with a nipple;

an upwardly facing circumferential second groove formed in the upper portion of the nipple, the outer portion of the second groove being defined by a flexible circumferential lip;

a resilient strip spirally wrapped about the underlisting sleeve between the underside of the cap and the lower portion of the nipple, the upper portion of the strip being formed with a tip received by the first groove of the sleeve, the lip being expandable outwardly to receive the lower end of the strip within the second groove to firmly retain the lower end of the strip within such second groove; and an adhesive applied to the underside of the strip to adhere the strip to the sleeve.

3. A method of making a golf club grip utilizing a frusto-conical mandrel, said method including:

providing a resilient underlisting sleeve formed at its upper end with a cap and at its lower end with a nipple, the nipple having an upwardly facing circumferential groove formed in its upper portion, the outer portion of the groove being defined by a flexible circumferential lip;

providing a resilient strip;

spirally wrapping the resilient strip about and adhering the strip to the underlisting sleeve between the underside of the cap and the lower portion of the groove of the nipple;

expanding the lip outwardly to receive and to securely retain the lower end of the strip within the groove to thereby secure the lower portion of the strip to the lower portion of the underlisting sleeve adhering the strip to the sleeve; and removing the assembled sleeve and strip from the mandrel.

4. A method of making a golf club grip utilizing a frusto-conical mandrel, said method including:

providing a resilient underlisting sleeve formed at its upper end with a cap and with a first groove, and at its lower end with a nipple, the nipple having an upwardly facing circumferential second groove formed in its upper portion, the outer portion of the second groove being defined by a flexible circumferential lip;

providing a resilient strip formed at its upper end with a tip;

spirally wrapping the resilient strip about the underlisting sleeve between the underside of the cap and the lower portion of the second groove of the nipple, with the tip of the sleeve being disposed in the first groove of the nipple;

expanding the lip outwardly to receive and retain the lower end of the strip within the second groove of the nipple to thereby secure the lower portion of the strip to the lower portion of the underlisting sleeve adhering the strip to the sleeve; and removing the assembled sleeve and strip from the mandrel.

* * * * *